United States Patent [19]

Galerne

[11] 4,094,160

[45] June 13, 1978

[54] DIVING BELL WITH TRANSPARENT DOOR FOR PANORAMIC VIEWING

[75] Inventor: Andre Galerne, Larchmont, N.Y.

[73] Assignee: International Underwater Contractors, Inc., Bronx, N.Y.

[21] Appl. No.: 795,112

[22] Filed: May 9, 1977

[51] Int. Cl.[2] ..... E05C 1/00

[52] U.S. Cl. ..... 61/69 R; 61/63

[58] Field of Search ..... 61/69 R, 69 A, 70, 71; 114/16 R, 50, 51

[56] References Cited

U.S. PATENT DOCUMENTS

| | | | |
|---|---|---|---|
| 1,321,562 | 11/1919 | Sisson | 61/69 R |
| 2,585,712 | 2/1952 | Wiggins | 61/69 R |
| 3,131,664 | 5/1964 | McInvale | 61/69 R UX |
| 3,422,965 | 1/1969 | Lloyd | 61/69 R X |
| 3,613,621 | 10/1971 | McKinley | 61/69 R X |
| 3,739,589 | 6/1973 | Wolfe | 61/69 R |

*Primary Examiner*—Dennis L. Taylor
*Attorney, Agent, or Firm*—Posnack, Roberts, Cohen & Spiecens

[57] ABSTRACT

A diving bell is provided with a cut-out or aperture from which extends a ring portion. Attached to one end of the ring portion is a transparent door or window maneuverable into position, for example, by a davit or by a hinge assembly mounted on the diving bell. The door or window includes a transparent hemispherical portion made of lucite or glass, and a hollow cylindrical extension which is connected at one end to the transparent hemispherical portion and at its other end to the ring portion. Dogging latches mounted on the end of the hollow cylindrical extension connected to the ring portion allow for the locking and unlocking of the transparent door or window further allows for panoramic viewing of the surrounding terrain or water, as well as the conversion of an observation diving bell into a working bell with remote control.

3 Claims, 4 Drawing Figures

42
43
36
53
20
37
38
26
E
11
18
10'
52
44
40
48
46
28
50
34'
34
32
30
22
20'

DIVING BELL WITH TRANSPARENT DOOR FOR PANORAMIC VIEWING

FIELD OF THE INVENTION

The present invention is relates to a diving bell for underwater work and exploration.

BACKGROUND OF THE INVENTION

Diving bells have long been known for underwater utility. They typically have consisted of a spherical hull in or from which a crew of men may work or from which a crew may observe the surrounding water or terrain, depending upon whether the diving bell is a lock-out bell or an observation bell.

In a lock-out bell, an air-lock provides the necessary interior pressure so that an opened bottom portion of the diving bell may be employed through which a crew of men may have access to the surrounding water. In an observation bell, the hollow hull is provided with small clear windows by which limited observation of the surrounding water may be effected for whatever particular pupose desired.

SUMMARY OF THE INVENTION

It is a primary object of the present invention to provide a relatively large transparent window, port or door on a portion of a conventional diving bell so that an observation diving bell may be converted to a lock-out or working bell.

According to the invention, a transparent door is removably mounted in front of a cut-out portion of the frame of a conventional diving bell, which cut-out portion is symmetrical with respect to a horizontal plane containing therein the horizontally-disposed diameters of the hollow frame of the diving bell. The transparent door or port is secured to a ring portion extending from the hollow frame via circumferentially-spaced dogging latches which are mounted on a hollow cylindrical extension of the transparent door. The front or first end of the hollow cylindrical extension is secured to a transparent hemispherical portion, while the other or second end having the dogging latches thereon is attachable by means of the dogging latches to the ring portion of the diving bell, in front of the cut-out portion.

The door may be opened and closed by the use of a davit mounted on the outer surface of the diving bell. Alternatively, the door may be hinged to the ring portion at one side thereof so that the door may pivoted outwardly to its opened position. The cut-out portion of the hollow frame to which the door is secured is generally of circular shape so as to conform with the end of the ring portion.

Another principal object of this invention is to provide for adopting conventional bells for panoramic viewing. This object involves, as explained more fully hereinafter, replacing a conventional door with a spherical viewing closure.

BRIEF DESCRIPTION OF THE DRAWING

The invention will be more readily understood with reference to the following detailed description, when taken in conjunction with the accompanying drawing, wherein.

DETAILED DESCRIPTION OF THE INVENTION

Figure 1:
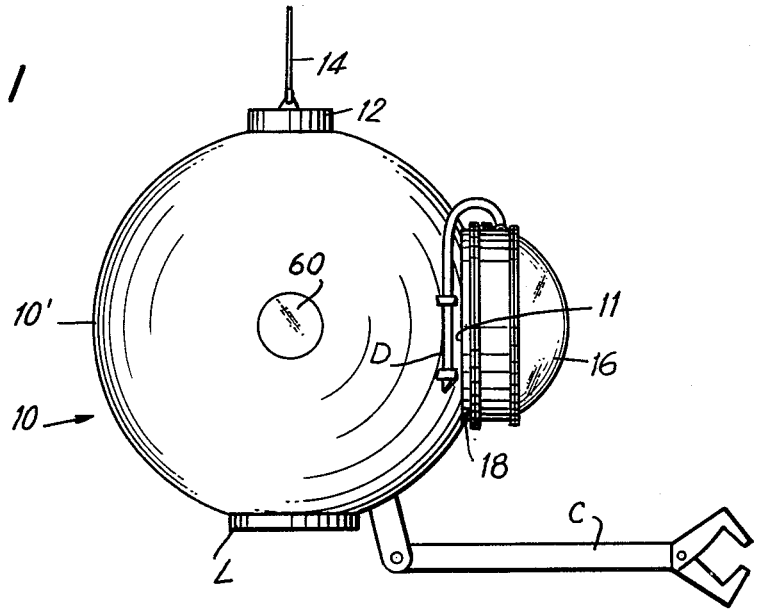
FIG. 1 illustrates a diving bell adapted for panoramic viewing with the transparent door of the invention.

In FIG. 1, there is shown an adapted diving bell 10 on which is mounted a bracket or loop support portion 12 for the reception therein of a hook or eye 14 of a cable of a lifting crane or winch (not shown) so that the diving bell 10 may be selectively raised and lowered. The diving bell 10 shown in FIG. 1 is provided with the transparent closure (i.e., port or window) of the present invention referred to generally by reference character 16, which fits over cut-out or aperture 11 formed in the hollow frame or hull 10'.

The transparent closure 16 is securable to a ring portion 18 of the hollow frame or hull 10' of the diving bell 10 and is connected around the cut-out 11. The transparent closure 16, because it is transparent, spherical and relatively large, allows for the panoramic observation of the surrounding water, underwater terrain, etc. by operators situated in the interior of the bell. In fact, the transparent closure converts the bell from one type to another and provides that the crew can make substantially improved observations and operate equipment (e.g., the claw C) from within the bell since the field of vision is greatly improved.

While the transparent closure 16 allows for more panoramic vision and hence for working from within the bell, it also allows for access to the diving bell at the surface. This results from its relatively large size in its preferred form. At the same time, an air-lock L allows for access to the exterior of the diving bell under water so that a crew can exit into the surrounding water for closehand work.

Figure 2:
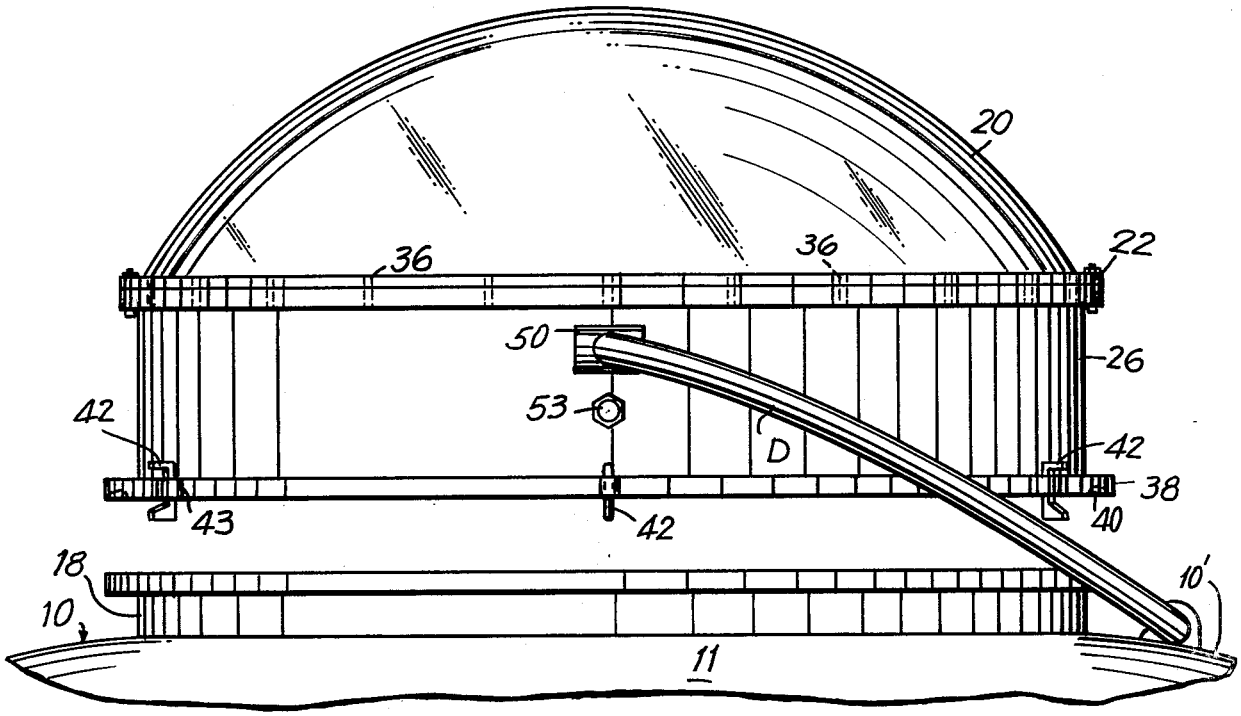
FIG. 2 is a top view showing the transparent door of the present invention in its spaced opened position relative to the accommodating ring portion of the hollow frame of the diving bell.
Figures 3, 4:
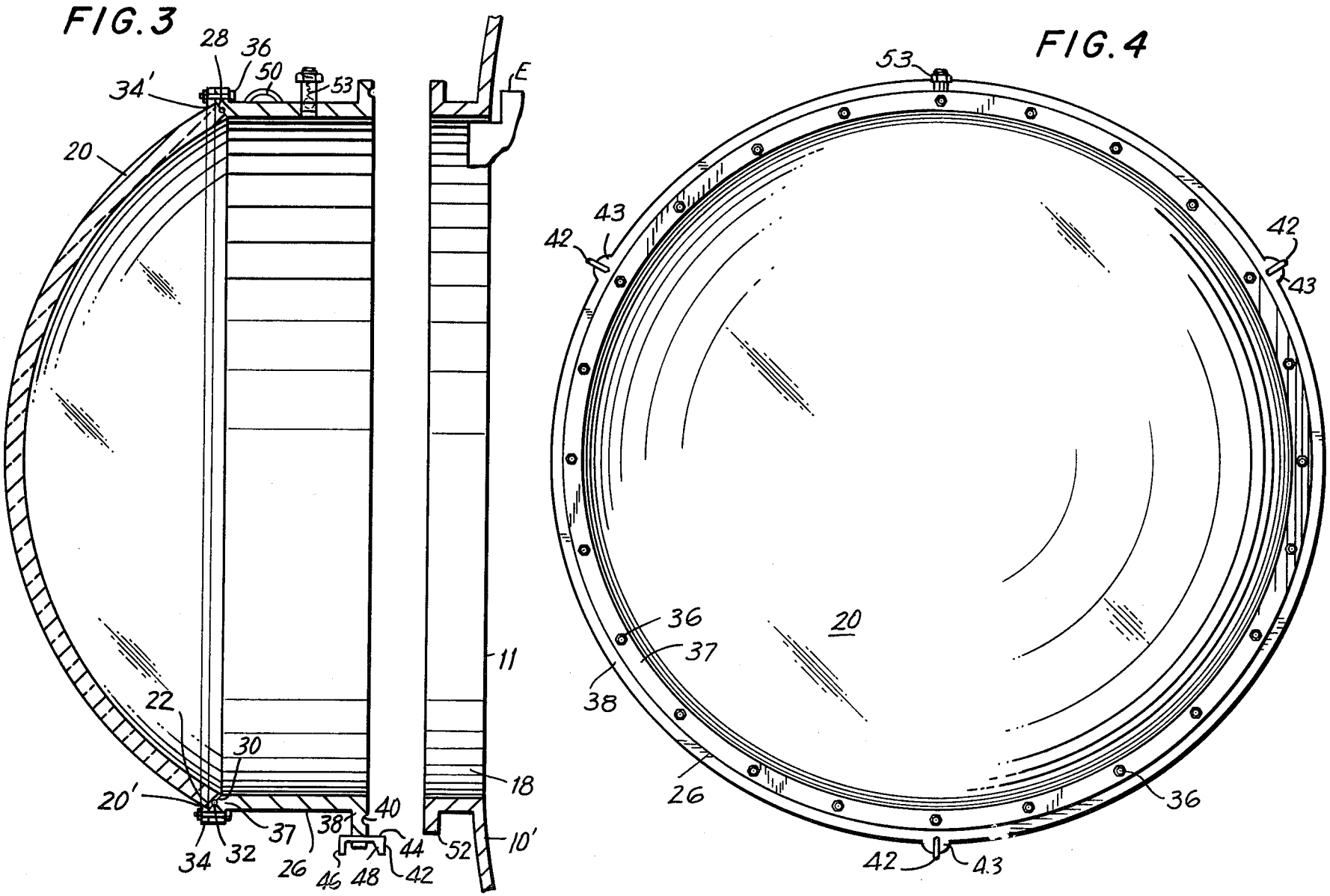
FIG. 3 is a side view showing the transparent door of the present invention in its spaced opened position relative to the cut-out portion of the hollow frame of the diving bell.
FIG. 4 is a front view of the transparent door of the present invention.

The transparent closure 16 of the invention is best seen in FIGS. 2–4. The closure 16 has a hemispherical portion 20 made of lucite, glass, or the like. As best seen in FIG. 3, the circular or circumferential end portion 22 of the portion 20 abuts end flange 37 of hollow cylindrical extension 26. The circular end portion 22 and the corresponding end flange 37 of the hollow cylindrical extension 26 have their surfaces similarly canted to provide a snug fit therebetween, as is shown at reference numerals 28 and 30. O-ring 32 seals off the connection between the two canted surfaces.

A mating annular ring 34 is provided about the circular end portion 22 of the hemispherical portion 20. The annular ring 34 is attached to the flange 37 by a plurality of bolts 36 spaced circumferentially about the flange 37 and the ring 34. The annular ring 34 has a canted surface 34' that forms a 90°angle with the canted surface 28, 30 so that the outer surface of the hemispherical portion 20 is self-centered and held in place thereby, as can be best seen in FIG. 4.

The hollow cylindrical extension 26 is provided at the other end thereof remote from the hemispherical portion 20 with a flange 38 for attaching the transparent closure to the ring portion 18. The flange 38 is provided with an O-ring receptacle in order to provide for sealing the connection between the flange 38 and the ring portion 18.

Also provided on the flange 38 and spaced equi-angularly about the flange are a plurality of dogging latches 42. In the drawing, only three such dogging latches are shown although it is to be understood that more than three dogging latches may be provided. Each dogging latch 42 has a rod portion 44 extending through an aperture of a protuberance 43 formed in the flange 38. Each latch further includes a perpendicular portion 46 and a cam portion 48. The dogging latches 42 are of conventional design and operate such that the cam portion 42 coacts with a locking surface formed in the ring portion 18. It will be realized that once the bell is underwater self-centering hydraulic forces will act to hold the closure in position and make the seal more secure.

The hollow cylindrical extension 26 is provided with a hook 50 by which a davit D mounted on the diving bell may control the movement of the transparent closure between its mounted and dismounted positions. The davit is conventionally a rotatable rod with a hooked end. Connection between the hooked end and the closure can be by flexible chain or line (not shown).

A conventional pressure relief valve 53 is provided to release trapped gas from the interior of the diving bell upon rising to the top. This will be especially important in the event of use of a lock-out door E (fragmentarily shown) which will define a separate pneumatic chamber within extension 26.

The ring portion 18 has a flange 52 of the same inner and outer diameters as the flange 38 of the hollow cylindrical extension 26. The flange 52 fits flush with the flange 38 so that the interior of the hollow cylindrical extension 26 and the interior of the ring portion 18, is preferably formed integrally with the frame 10, are aligned with each other and with cut-out 11 as shown in FIG. 3. In a conventional bell, ring portion 18 may accommodate door E effective from the inside against internal pressures and an outer door (not shown) which is replaced by the transparent closure and would be effective against external pressures.

While the transparent door may be opened and closed by the use of a davit, it is to be understood that hinges may be used instead. Such hinges would connect one side of the flange 38 to one side of the flange 52 whereby the door can be pivotally opened and closed. Alternatively, the flange 38 and the frame 10' may be connected via a linkage mechanism whereby additional articulation of the door, such as outward pivotal movement combined with horizontal movement, may be achieved.

In use, the transparent closure may serve initially as the entrance for the crew of the diving bell before descent into the water although lower lock L may also serve this purpose. The closure is locked in place by use of the davit and dogging latches. The diving bell is conventionally lowered into the water where the crew may make observations through the conventional port 60. However, observations and working are greatly facilitated by use of the transparent closure 16. For performance of work by the crew, remote control arms of conventional design (e.g., claw C) may be provided in the vicinity of the transparent hemispherical portion 20 where a clear view of the manipulations of such remote control arms is possible.

The transparent hemispherical portion 20 is preferably of Lucite but may be alternatively of other clear plastic or glass or the like. By way of example, Lucite will have a wall thickness of approximately 4 inches when the depth to which the vessel is to be submerged is about 2,800 feet. The inner diameters of the hollow cylindrical extension 26 and the ring portion 18 may range, for example, from 10 inches to 48 inches. However, for panoramic viewing, a diameter of about 3 to 4 feet is preferred with the closure constituting about one-third to one-fourth the diameter of the bell.

While the invention has been described above relative to the structural characteristics of one embodiment, it is to be understood that the invention has as another phase thereof the adapting of conventional bells. For example, the ring-encircled cut-out portion described above may have, in a conventional bell, inner and outer doors operating selectively against internal or external pressure. The invention provides, in such case, for the substitution of the panoramic viewing window for one or both such doors. The substituted viewing window (called "closure" above) will have a size which is roughly that of the replaced door thereby providing for panoramic viewing. Due to its spherical shape, it will be able to resist pressures at extreme submerged depths.

Such a substituted window may be locatable directly on the ring on the bell hull. However, the use of the intervening adaptive cylinder allows for the provision of the correspondingly canted surfaces between the window periphery and the cylinder end. These correspondingly canted surfaces convert the pressure on the viewing window into seal improving forces. The cylinder thus acts as an adaptor between the window and ring.

While a specific embodiment has been shown and described, it is to be understood that numerous changes and modifications may be made without departing from the scope and spirit of the invention.

What is claimed is:

1. In a diving bell having a hollow frame in which is defined a cut-out portion; an improvement comprising a transparent closure adapted for being positioned in front of said cut-out portion and moveable between an opened position and a closed position; and means mounting said transparent closure in front of said cut-out portion so that said transparent closure is in alignment with said cut-out portion when said transparent closure is in its closed position, whereby panoramic observations may be made from within the bell; said transparent closure comprising a transparent, hemispherical portion having a circular end portion; a hollow cylindrical extension having a first end for supporting said circular end portion of said hemispherical portion thereon, and a second end spaced from said first end; and means mounting said circular end portion of said hemispherical portion on said first end of said hollow cylindrical extension; said means mounting said circular end portion on said first end comprising: a flange positioned about said first end of said hollow cylindrical extension, said flange and circular end portion of said hemispherical portion each having a canted surface of the same angle; and an annular ring positioned on said flange in a direction away from said second end of said hollow cylindrical extension, said annular ring having a canted surface that is perpendicular to the canted surface of said flange, said annular ring engaging said hemispherical portion adjacent said circular end portion, whereby the canted surfaces of said flange and said annular ring hold said circular end portion of said hemispherical portion so that said hemispherical portion is supported therein.

2. The improvement according to claim 1 wherein said means mounting said circular end portion on said first end comprises a plurality of bolts fastening together said annular ring and said flange, said annular ring and said flange being mounted flush against each other.

3. The improvement according to claim 2 wherein said means mounting said circular end portion on said first end further comprises an O-ring positioned between said canted surface of said circular end portion and said canted surface of said flange, whereby a tight seal is provided.

* * * * *